US010309117B1

(12) United States Patent
Comorski

(10) Patent No.: US 10,309,117 B1
(45) Date of Patent: Jun. 4, 2019

(54) DRYWALL REMOVAL TOOL

(71) Applicant: David Comorski, Colonie, NY (US)

(72) Inventor: David Comorski, Colonie, NY (US)

( * ) Notice: Subject to any disclaimer, the term of this patent is extended or adjusted under 35 U.S.C. 154(b) by 0 days.

(21) Appl. No.: 16/043,341

(22) Filed: Jul. 24, 2018

(51) Int. Cl.
*B25B 9/00* (2006.01)
*E04G 23/08* (2006.01)

(52) U.S. Cl.
CPC ..... *E04G 23/08* (2013.01)

(58) Field of Classification Search
CPC ..... B25B 1/20; B25B 1/2405; B25B 19/00; B23P 11/005; B25D 1/00; B21J 5/00
See application file for complete search history.

(56) References Cited

U.S. PATENT DOCUMENTS 3,791,012 A 2/1974 Jenkin
4,237,614 A * 12/1980 Williams ..... E04F 21/00 269/43
5,148,599 A 9/1992 Purcell
5,370,192 A 12/1994 Evinger
5,611,189 A * 3/1997 Fleck ..... E04D 13/158 269/41
6,308,934 B1 10/2001 Gallo
6,820,868 B1 * 11/2004 Reymus ..... E04D 13/158 269/152
6,880,217 B2 * 4/2005 Garst ..... B25B 27/0028 29/235
6,962,326 B2 11/2005 Else
7,168,144 B1 1/2007 Haelle
7,210,676 B1 * 5/2007 Blau ..... E04F 21/0069 269/37
7,618,031 B2 11/2009 Weaver
8,407,874 B2 * 4/2013 Giberti ..... B25F 1/003 254/18
9,657,486 B2 5/2017 Raymond

FOREIGN PATENT DOCUMENTS

WO 2002004338 1/2002

* cited by examiner

*Primary Examiner* — Lee D Wilson
(74) *Attorney, Agent, or Firm* — Kyle A. Fletcher, Esq.

(57) ABSTRACT

The drywall removal tool is a hand operated tool that assists in the removal of drywall from a wall or ceiling. The tool comprises a wrecker plate that slides through a slot punched in the drywall to a position behind the drywall, a connecting plate that couples the wrecker plate to the handle plate, a handle plate that is a plate located in front of the drywall, a handle coupled to the handle plate, and a hammer that may be moved to produce an impulse of force to break the drywall free of obstructions and fasteners. The slot that the wrecker plate passes through may be made by striking the drywall with a slot maker located on the top of the connecting plate.

20 Claims, 4 Drawing Sheets

DRYWALL REMOVAL TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of demolition, more specifically, a drywall removal tool.

SUMMARY OF INVENTION

The drywall removal tool is a hand operated tool that assists in the removal of drywall from a wall or ceiling. The tool comprises a wrecker plate that slides through a slot punched in the drywall to a position behind the drywall, a connecting plate that couples the wrecker plate to the handle plate, a handle plate that is a plate located in front of the drywall, a handle coupled to the handle plate, and a hammer that may be moved to produce an impulse of force to break the drywall free of obstructions and fasteners. The slot that the wrecker plate passes through may be made by striking the drywall with a slot maker located on the top of the connecting plate.

An object of the invention is to remove drywall from a wall or ceiling.

Another object of the invention is to provide a wrecker plate that may be position behind the drywall and pulled using a handle.

A further object of the invention is to provide a slide hammer for applying impulses of force to the drywall.

Yet another object of the invention is to provide a slot maker to punch a slot for the wrecker plate to pass through.

These together with additional objects, features and advantages of the drywall removal tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the drywall removal tool in detail, it is to be understood that the drywall removal tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the drywall removal tool.

It is therefore important that the claims be regarded as including such equivalent construction insofar as they do not depart from the spirit and scope of the drywall removal tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
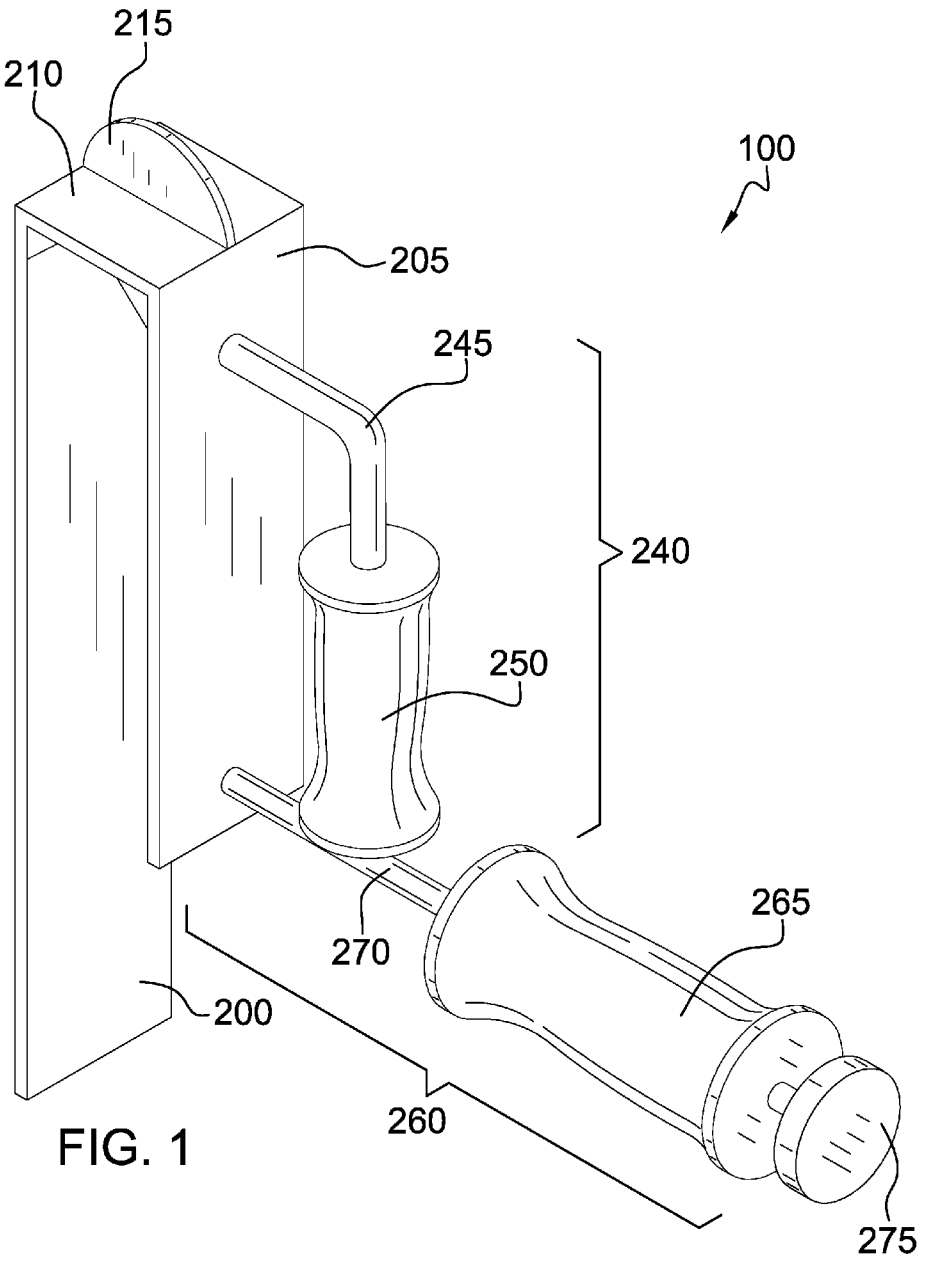
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 6.

The drywall removal tool 100 (hereinafter invention) comprises a wrecker plate 200, a handle plate 205, a connecting plate 210, a slot maker 215, a handle 240, and a hammer 260. The invention 100 is a tool that aids in the removal of drywall. The invention 100 is adapted to be used by a worker to punch a starter slot in the drywall, to slide the wrecker plate 200 through the starter slot to a position behind the drywall, and/or to pull the drywall away from a wall using the wrecker plate 200 and the handle 240.

Figure 2:
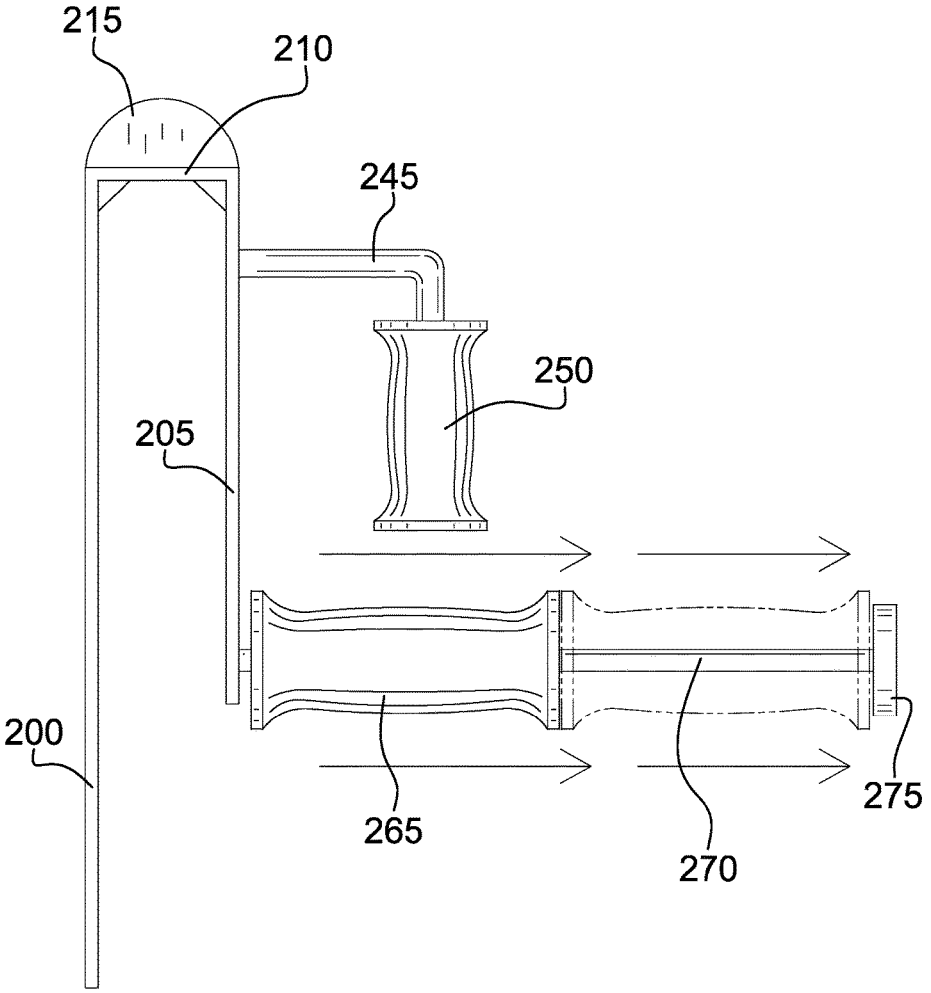
FIG. 2 is an in-use view of an embodiment of the disclosure.
Figure 3:
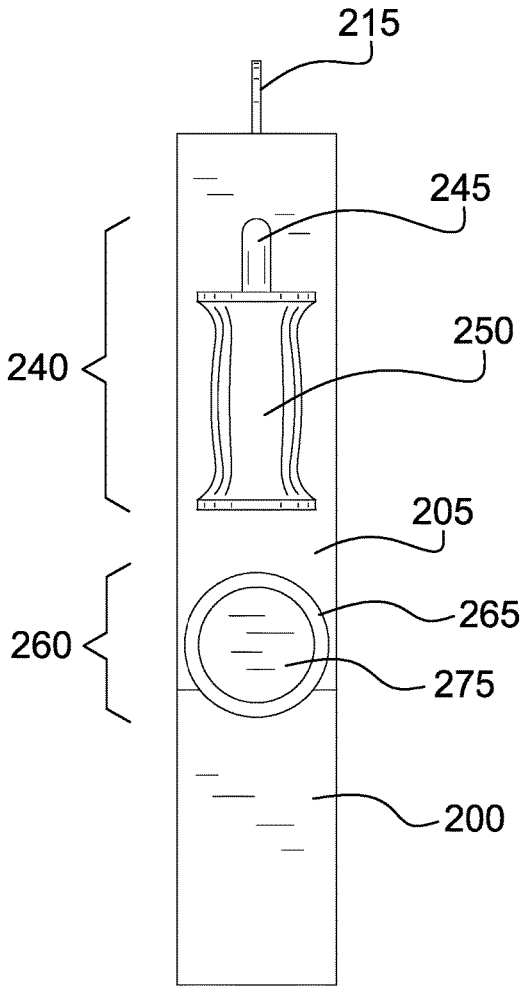
FIG. 3 is a front view of an embodiment of the disclosure from the proximal side.
Figure 4:
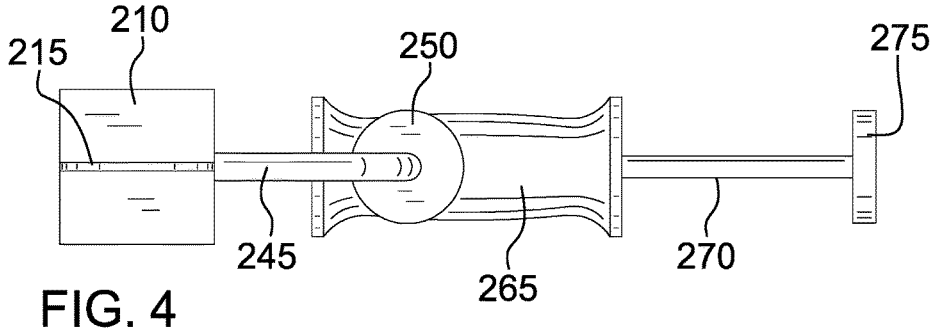
FIG. 4 is a top view of an embodiment of the disclosure.
Figure 5:
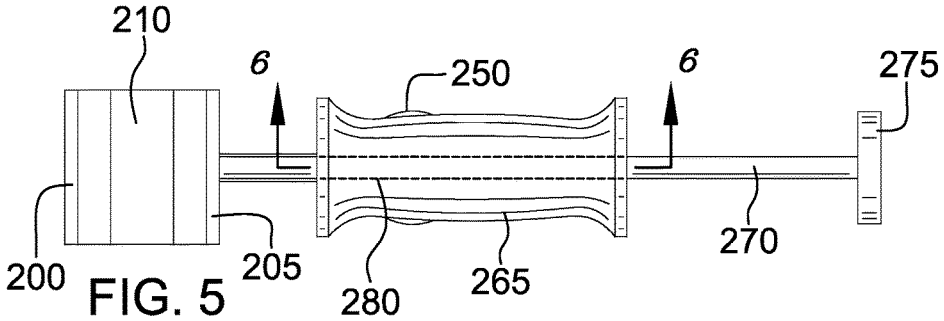
FIG. 5 is a bottom view of an embodiment of the disclosure.
Figure 6:
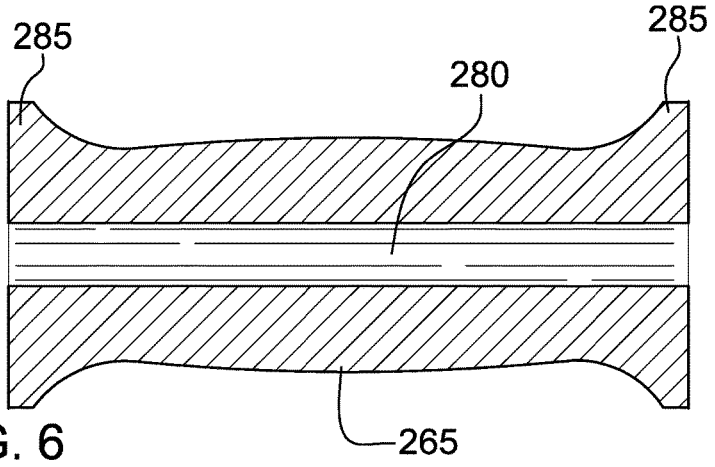
FIG. 6 is a cross-sectional view of an embodiment of the disclosure across 6-6 as shown in FIG. 5.

The wrecker plate 200 may be a vertically oriented, rectangular plate located on the distal side of the invention 100. (Throughout this document, directional references such as up and down reflect the orientation of the invention 100 as shown in FIGS. 1 through 3. The proximal side of the invention 100 is the side where the handle 240 and the hammer 260 are located and the distal side is the side where the wrecker plate 200 is located.) The wrecker plate 200 may slide bottom edge first through the starter slot in the drywall to position the wrecker plate 200 behind the drywall.

The handle plate 205 may be a vertically oriented, rectangular plate, which runs parallel to the wrecker plate 200. The handle plate 205 may be aligned with the wrecker plate 200 such that a ray drawn perpendicular to the handle plate 205 and towards the wrecker plate 200 from any point on the handle plate 205 passes through the wrecker plate 200. The top of the handle plate 205 may be at the same height as the top end of the wrecker plate 200. The lateral width of the handle plate 205 may be the same as the lateral width of the wrecker plate 200. The handle plate 205 may be shorter than the wrecker plate 200 in the vertical direction.

The connecting plate 210 may be a horizontally oriented, square plate, which couples the wrecker plate 200 to the handle plate 205. The connecting plate 210 may be the same lateral width as the wrecker plate 200 and the handle plate 205.

In some embodiments, the wrecker plate 200, the handle plate 205, and the connecting plate 210 may be molded, extruded, bent, or otherwise formed from a single piece of material.

In some embodiments, the wrecker plate 200, the handle plate 205, and the connecting plate 210 may be made from a durable, rigid material. As a non-limiting example, the material may be a metal such as a steel.

The slot maker 215 may be used to punch the starter slot into the drywall when the invention 100 is swung such that the slot maker 215 strikes the drywall first. The slot maker 215 may be a vertical plate protruding from the top of the connecting plate 210. The slot maker 215 may be oriented to be perpendicular to the wrecker plate 200 and to the handle plate 205 such that when the wrecker plate 200 is passed through the starter slot in the drywall the edge of the slot maker 215 may be forced through the drywall above the starter slot to position the wrecker plate 200 fully behind the drywall. In some embodiments, the slot maker 215 may have a semicircular profile.

The handle 240 comprises a handle shaft 245 and a handle grip 250. The handle 240 may be used to grasp and to manipulate the invention 100. The handle 240 may be used to pull the drywall when the wrecker plate 200 is positioned behind the drywall.

The handle shaft 245 may be an L-shaped armature that couples to the upper half of the proximal side of the handle plate 205 on one end and couples to the handle grip 250 on the other end. The handle shaft 245 may be oriented such that the long leg of the L runs parallel to the handle plate 205 in a downwards direction. The handle grip 250 may be a cushioned, cylindrical covering for the handle shaft 245. The handle grip 250 may surround the long leg of the handle shaft 245.

The hammer 260 comprises a hammer weight 265, a hammer shaft 270, and a hammer stop 275. The hammer 260 may be a slide hammer coupled to the handle plate 205.

The hammer weight 265 may be a cylindrical mass with a central aperture 280 running longitudinally through the center of the hammer weight 265. The hammer weight 265 may comprise a contoured exterior such that the longitudinal ends 285 of the hammer weight 265 are wider than the center of the hammer weight 265. The longitudinal ends 285 of the hammer weight 265 may be adapted to protect the fingers of the worker.

The hammer shaft 270 may be a straight armature extending perpendicularly from the proximal side of the handle plate 205 on the lower half of the handle plate 205. The diameter of the hammer shaft 270 may be less than the diameter of the central aperture 280 in the hammer weight 265 such that the hammer shaft 270 may pass through the central aperture 280 and the hammer weight 265 may slide on the hammer shaft 270.

The hammer stop 275 may be an enlarged proximal end of the hammer shaft 270. The hammer stop 275 may be of a larger diameter than the central aperture 280 of the hammer weight 265 such that the hammer weight 265 is prevented from separating from the hammer shaft 270 due to the presence of the hammer stop 275. As a non-limiting example, the hammer stop 275 may be a disk or ball coupled to the proximal end of the hammer shaft 270.

In use, the invention 100 may be held by the handle 240 and swung against the wall such that the slot maker 215 strikes the wall and punches the starter slot into the drywall. The bottom end of the wrecker plate 200 may be inserted into the starter slot and pushed into the starter slot up to the top end of the wrecker plate 200. The invention 100 may then be pivoted to force the slot maker 215 through the drywall adjacent to the starter slot such that the wrecker plate 200 is behind the drywall and is parallel to the drywall. The handle 240 may then be used to pull the wrecker plate 200 which may pull a portion of the drywall with it. The portion of the drywall removed by extracting the wrecker plate 200 may be much larger than the wrecker plate 200.

Having made an initial hole in the drywall, the wrecker plate 200 may be inserted behind the drywall that remains by hooking the invention 100 over the edge of the drywall and the wrecker plate 200 may be extracted again to remove more of the drywall. The steps of inserting the wrecker plate 200 behind the drywall and pulling the wrecker plate 200 out may be repeated until the drywall is removed.

If, as a non-limiting example, it is difficult to pull the wrecker plate 200 through the drywall because the invention 100 is laterally adjacent to one or more drywall screws, the hammer 260 may be used to break the drywall free. To use the hammer 260, with the wrecker plate 200 positioned behind the drywall the hammer weight 265 is slid slowly towards the handle 240 and then rapidly jammed against the hammer stop 275. The inertia of the hammer weight 265 may be transferred to the hammer stop 275 and then to the hammer shaft 270, which pulls the invention 100 towards the hammer stop 275. This may cause the wrecker plate to pull on the drywall with the force needed to break the drywall free of the one or more drywall screws.

DEFINITIONS

As used in this disclosure, an "aperture" is an opening in a surface. Aperture may be synonymous with hole, slit, crack, gap, slot, or opening.

As used in this disclosure, a "ball" refers to an object with a spherical or nearly spherical shape.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "disk" is a cylindrically shaped object with parallel opposing sides. A disk generally has a thickness (as measured from flat side to flat side) that is less than the radius of the cylinder.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point or a central axis of an object and the direction of comparison may be in a radial or lateral direction.

As used herein, the word "durable" refers to a material's ability to withstand wear, pressure, impact, heat, cold, sun exposure, and other forms of potentially damaging conditions without suffering any significant deterioration of quality or value.

As used in this disclosure, the word "exterior" is used as a relational term that implies that an object is not located or contained within the boundary of a structure or a space.

As used in this disclosure, a "grip" is a covering that is placed over a hand hold, handle, shaft, or other object.

As used in this disclosure, a "handle" is an object by which a tool, object, or door is held or manipulated with the hand.

As used in this disclosure, the word "lateral" refers to the sides of an object or movement towards a side. Lateral directions are generally perpendicular to longitudinal directions. "Laterally" refers to movement in a lateral direction.

As used herein, the word "longitudinal" or "longitudinally" refers to a lengthwise or longest direction.

As used herein, a "longitudinal edge" or "longitudinal end" is an edge or end that is reached when traversing an object in a longitudinal direction.

As used in this disclosure, "orientation" refers to the positioning and/or angular alignment of a first object relative to a second object or relative to a reference position or reference direction.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used in this disclosure, the term "shaft" is used to describe a rigid cylinder that is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used herein, "slide hammer" refers to a tool that is capable of pulling an object that it is coupled to without impacting the object itself. A slide hammer typically comprises a shaft, a stop, and a weight that slides along the shaft. The slide hammer transfers the inertia of the weight to the shaft when the weight is moved away from the point of attachment and strikes the stop at the end of the shaft. The shaft may utilize the inertia to pull on the object at the point of attachment.

As used in this disclosure, a "slot" is a long narrow groove, cut, opening, or aperture that is formed in or through an object.

As used in this disclosure, a "tool" is a device, an apparatus, or an instrument that is used to carry out an activity, operation, or procedure.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A drywall removal tool comprising:

a wrecker plate, a handle plate, a connecting plate, a slot maker, a handle, and a hammer;

wherein the drywall removal tool is a tool that aids in the removal of drywall;

wherein the drywall removal tool is adapted to be used by a worker to punch a starter slot in the drywall, to slide the wrecker plate through the starter slot to a position behind the drywall, or to pull the drywall away from a wall using the wrecker plate and the handle.

2. The drywall removal tool according to claim 1 wherein the wrecker plate is a vertically oriented, rectangular plate located on the distal side of the drywall removal tool;

wherein the wrecker plate slides bottom edge first through the starter slot in the drywall to position the wrecker plate behind the drywall.

3. The drywall removal tool according to claim 2 wherein the handle plate is a vertically oriented, rectangular plate which runs parallel to the wrecker plate.

4. The drywall removal tool according to claim 3 wherein the handle plate is aligned with the wrecker plate such that a ray drawn perpendicular to the handle plate and towards the wrecker plate from any point on the handle plate passes through the wrecker plate;

wherein the top of the handle plate is at the same height as the top end of the wrecker plate.

5. The drywall removal tool according to claim 4 wherein the lateral width of the handle plate is the same as the lateral width of the wrecker plate;

wherein the handle plate is shorter than the wrecker plate in the vertical direction.

6. The drywall removal tool according to claim 5 wherein the connecting plate is a horizontally oriented, square plate which couples the wrecker plate to the handle plate;

wherein the connecting plate is the same lateral width as the wrecker plate and the handle plate.

7. The drywall removal tool according to claim 6 wherein the wrecker plate, the handle plate, and the connecting plate are molded, extruded, bent, or otherwise formed from a single piece of material.

8. The drywall removal tool according to claim 6
wherein the wrecker plate, the handle plate, and the connecting plate are made from a durable, rigid material.

9. The drywall removal tool according to claim 8
wherein the material is a metal such as a steel.

10. The drywall removal tool according to claim 8
wherein the slot maker is used to punch the starter slot into the drywall when the drywall removal tool is swung such that the slot maker strikes the drywall first;
wherein the slot maker is a vertical plate protruding from the top of the connecting plate.

11. The drywall removal tool according to claim 10
wherein the slot maker is oriented to be perpendicular to the wrecker plate and to the handle plate such that when the wrecker plate is passed through the starter slot in the drywall the edge of the slot maker is forced through the drywall above the starter slot to position the wrecker plate fully behind the drywall.

12. The drywall removal tool according to claim 11
wherein the slot maker has a semicircular profile.

13. The drywall removal tool according to claim 11
wherein the handle comprises a handle shaft and a handle grip;
wherein the handle is used to grasp and to manipulate the drywall removal tool;
wherein the handle is used to pull the drywall when the wrecker plate is positioned behind the drywall.

14. The drywall removal tool according to claim 13
wherein the handle shaft is an L-shaped armature that couples to the upper half of the proximal side of the handle plate on one end and couples to the handle grip on the other end;
wherein the handle shaft is oriented such that the long leg of the L runs parallel to the handle plate in a downwards direction;
wherein the handle grip is a cushioned, cylindrical covering for the handle shaft;
wherein the handle grip surrounds the long leg of the handle shaft.

15. The drywall removal tool according to claim 14
wherein the hammer comprises a hammer weight, a hammer shaft, and a hammer stop;
wherein the hammer is a slide hammer coupled to the handle plate.

16. The drywall removal tool according to claim 15
wherein the hammer weight is a cylindrical mass with a central aperture running longitudinally through the center of the hammer weight.

17. The drywall removal tool according to claim 16
wherein the hammer weight comprises a contoured exterior such that the longitudinal ends of the hammer weight are wider than the center of the hammer weight;
wherein the longitudinal ends of the hammer weight are adapted to protect the fingers of the worker.

18. The drywall removal tool according to claim 17
wherein the hammer shaft is a straight armature extending perpendicularly from the proximal side of the handle plate on the lower half of the handle plate;
wherein the diameter of the hammer shaft is less than the diameter of the central aperture in the hammer weight such that the hammer shaft passes through the central aperture and the hammer weight slides on the hammer shaft.

19. The drywall removal tool according to claim 18
wherein the hammer stop is an enlarged proximal end of the hammer shaft;
wherein the hammer stop is of a larger diameter than the central aperture of the hammer weight such that the hammer weight is prevented from separating from the hammer shaft due to the presence of the hammer stop.

20. The drywall removal tool according to claim 19
wherein the hammer stop is a disk or ball coupled to the proximal end of the hammer shaft.

* * * * *